United States Patent [19]

Kinney, Jr.

[11] 4,044,583

[45] Aug. 30, 1977

[54] METHOD AND APPARATUS FOR MAKING ELONGATED FLAT WIRE COILS

[75] Inventor: C. Mills Kinney, Jr., Washington, D.C.

[73] Assignee: Wire Conveyor Belts, Inc., Easton, Md.

[21] Appl. No.: 690,793

[22] Filed: May 27, 1976

[51] Int. Cl.[2] ..... B21F 3/04

[52] U.S. Cl. ..... 72/137; 140/92.4; 140/92.94

[58] Field of Search ..... 140/92.3, 92.4, 92.7, 140/92.94; 72/135, 137, 138, 142

[56] References Cited

U.S. PATENT DOCUMENTS 2,455,549 12/1948 Benjamin ..... 72/138

3,404,711 10/1968 Whitcomb ..... 140/92.3

*Primary Examiner*—Lowell A. Larson

*Attorney, Agent, or Firm*—Mason, Fenwick & Lawrence

[57] ABSTRACT

A wire winding blade extends through spiral outfeed guide members and receives spring-like unannealed wire from a source drawn by rotation of the winding blade; the wire from the source first passes through tensioning means then over an infeed guide pulley which guides it into a linear guide member having a bore slightly in excess of the wire diameter from which the wire passes over a small diameter idler roller sheave which imparts a back bend to the wire which is then fed into the slot of the spiral wire guide means where it is bent in a reverse manner about the winding blade.

18 Claims, 4 Drawing Figures

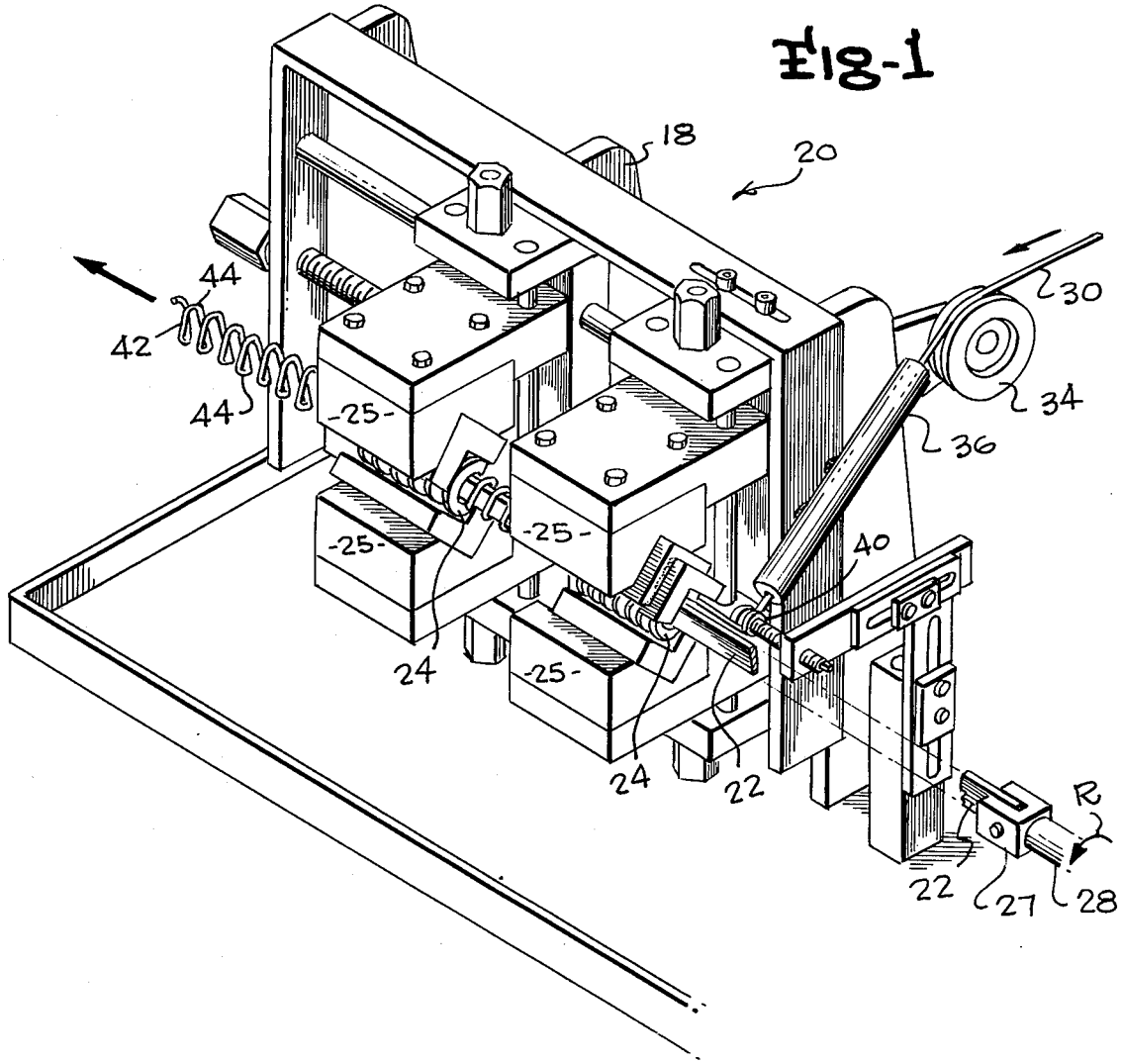
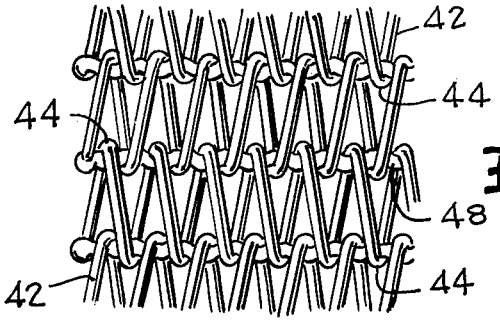
Fig-2

METHOD AND APPARATUS FOR MAKING ELONGATED FLAT WIRE COILS

BACKGROUND OF THE INVENTION

Woven wire conveyor belts have been used for many years in the glass and other industries for conveying items through hot and/or caustic environments. Such woven wire conveyor belts are formed of a plurality of interlocked elongated flat spiral annealed steal wire members consisting of a large number of spirals with each spiral comprising spaced essentially linear top and bottom leg portions connected by arcuately curved end portions. The arcuately curved end portions of each elongated flat spiral member are interleaved with the adjacent arcuately curved end portions of the next adjacent elongated flat spiral member and a crimped rod extends through the interleaved portions of the spiral members to retain the elongated flat spiral wire members in position and permit pivotal movement of each elongated flat spiral member with respect to the next adjacent elongated flat spiral member.

It has been conventional practice to form woven conveyor belts of the aforementioned type of annealed steel alloy or other similar relatively pliable wire having a maximum tensile strength in the range of 65,000 to 100,000 pounds per square inch. Each of the flat spiral members is formed by feeding the wire to a flat rotating winding blade supported for rotation on one end and having an opposite end extending through a spiral outfeed guide having a spiral slot surrounding the rotating winding blade. The wire is fed in through the slot of the spiral onto the winding blade. Rotation of the winding blade causes the wire to be wound onto the surface of the winding blade in a configuration following the configuration of the spiral slot of the flat outfeed spiral member so that an elongated flat spiral of wire is formed and moved outwardly to the unsupported end of the rotating winding blade.

Since the wire used in forming the flat spiral members is subject to a substantial amount of bending and tension beyond its elastic limit as it is wound about the rotary winding blade, it is consequently much less difficult to form the flat spiral members of relatively soft wire due to the ease with which such wire can be wound in the necessary spiral formation. It has consequently been the practice in the industry to use relatively soft annealed steel for forming the vast majority of spiral wire members used in conveyor belts. However, annealed wire, which is formed by taking as-drawn wire from the drawing mill, heating same to annealling temperature or higher and then slowly cooling the wire to provide a relatively soft wire, has less tensile strength than the tensile strength of the as-drawn wire from which it is formed notwithstanding the fact that the as-drawn wire and the annealed wire are of identical chemical composition. In addition, the annealling process obviously adds 10% to 15% to the cost of the wire over and above the cost of as-drawn wire and belts formed of the annealed wire are relatively heavy due to the fact that they must be formed of wire of sufficient diameter to provide the required tensile strength for a given conveyor belt installation. Moreover, the heaviness and mass of the presently used conveyor belts formed of annealed steel results in greater power consumption for driving the belts and greater heat absorption than would be the case if the lighter weight material were employed. Similarly, many installations such as those in the glass industry employ woven conveyor belt conveyors which move through heated areas such as furnaces or lehrs and absorb a substantial amount of heat. Subsequent movement from the heated areas to areas external of the heated areas results in radiation and convection loss of absorbed heat to the surrounding area. Such heat loss is obviously undesirable and is becoming all the more critical in view of the ever increasing cost of fuel. By enabling the use of smaller wire, the present invention lowers the heat loss since there is less thermal storage capacity in the conveyor.

Previous attempts to form elongated flat spiral wire members of as-drawn steel or other similar spring-like wire have not been successful due to the fact that existing wire winding devices and processes for forming the elongated flat spiral members have been incapable of winding spring-like metal into uniform elongated spiral wire members having the uniformity of shape necessary for use in forming woven conveyor belts. The foregoing is true due to the fact that the spiral wire members formed of as-drawn or similar spring-like steel or the like have varied dimensionally in terms of pitch between adjacent spirals and have had internal stresses creating an irregular axial twisting of the spiral members along their lengths so that the spiral members cannot be connected together to form a satisfactory conveyor belt.

Therefore, it is the primary object of this invention to provide a new and improved means and method of forming woven conveyor belts of lighter weight and/or higher strength materials than has been heretofore possible.

Another object of the invention is the provision of a new and improved apparatus and method for forming flattened elongated flat spiral wire members of lightweight high strength material.

Still another object of the invention is the provision of a new and improved apparatus and method for forming elongated flat spiral wire members of spring-like as-drawn steel alloy having a tensile strength in excess of 100,000 to 150,000 pounds per square inch.

Achievement of the objects of this invention is enabled by the preferred embodiment of the subject invention by the provision of unique controlled wire feeding, guiding and bending means for feeding spring-like wire to a conventional forming station consisting of a rotating winding blade extending through a flat spiral outfeed worm member. In the preferred embodiment, unannealed as-drawn steel alloy wire is fed through an elongated linear guide means in which a circular bore is provided with the circular bore being of slightly greater diameter than the diameter of the particular wire being employed so that the wire is fixedly guided along a linear path. The wire leaves the downstream end of the circular bore and passes immediately over bending means consisting of a small diameter roller member about which the wire is bent beyond its elastic limit so as to impart a set bend in the wire. The aforementioned roller means is positioned immediately upstream of the location in a conventional forming station at which the wire extends into the spiral groove of the relatively flat outfeed spiral member and is wound about the winding blade. Winding movement of the wire about the blade results in the wire being bent in the exact direction from the set bend so that the wire is closely configured to the surface of the winding blade.

The basic difference of the invention over the prior art approaches is in the provision of the guide means for completely stabilizing the feed of the wire practically up to the exact point of winding as opposed to the prior systems in which the internal stresses in the wire have been the cause of transverse shift in or whipping movement of the wire as it is fed onto the winding blade. Consequently, variations in internal stress occur at different locations in the finished spiral member to cause resultant undesirable bending and twisting of the spiral. In the present invention, the wire is guided and stabilized along a restricted linear path and then fed immediately over the back bend roller which bends the wire in a vertical plane which restrains the wire from transverse movement so as to prevent whipping of the wire member as has previously occurred with prior known systems. Moreover, the wire as it leaves the back bend roller member immediately engages one side of the groove in the spiral worm so that the wire feed is totally controlled up to the point that the wire is wrapped about the winding blade.

A better understanding of the inventive apparatus and method will be achieved when the following written description is considered in conjunction with the appended drawings in which:

FIG. 1 is a perspective view of the components for practice of the preferred embodiment of the invention;

FIG. 2 is a plan view of a portion of a wire conveyor belt formed of elongated flattened wire spiral members as produced by the inventive method and apparatus;

Figure 3:
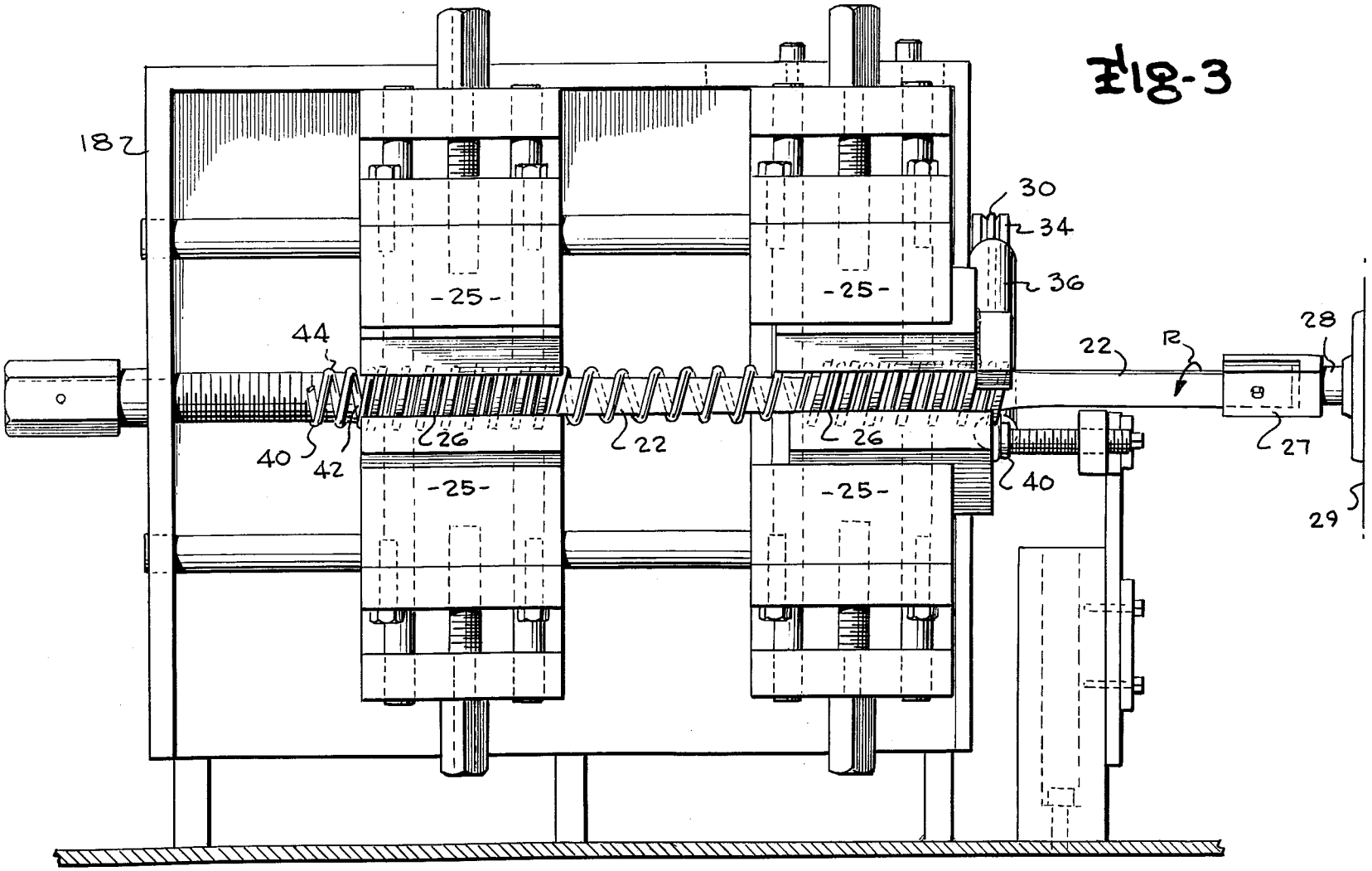
FIG. 3 is a front elevation of the apparatus of FIG. 1.

The preferred embodiment for practice of the invention is illustrated in the drawings and includes a frame 18 supporting a conventional wire bending and forming station 20 in which a rotating winding blade 22 extends through spiral outfeed guide members 24 clamped in adjusted position by conventional support members 25 on frame 18. Each of the spiral outfeed guide members defines a spiral slot 26. It will be noted that the rotary winding blade 22 is connected by a clevis connector 27 to the output shaft 28 of a power source in housing 29 which imparts rotation to the blade member in the direction of arrows R in FIGS. 1 and 3.

Figure 4:
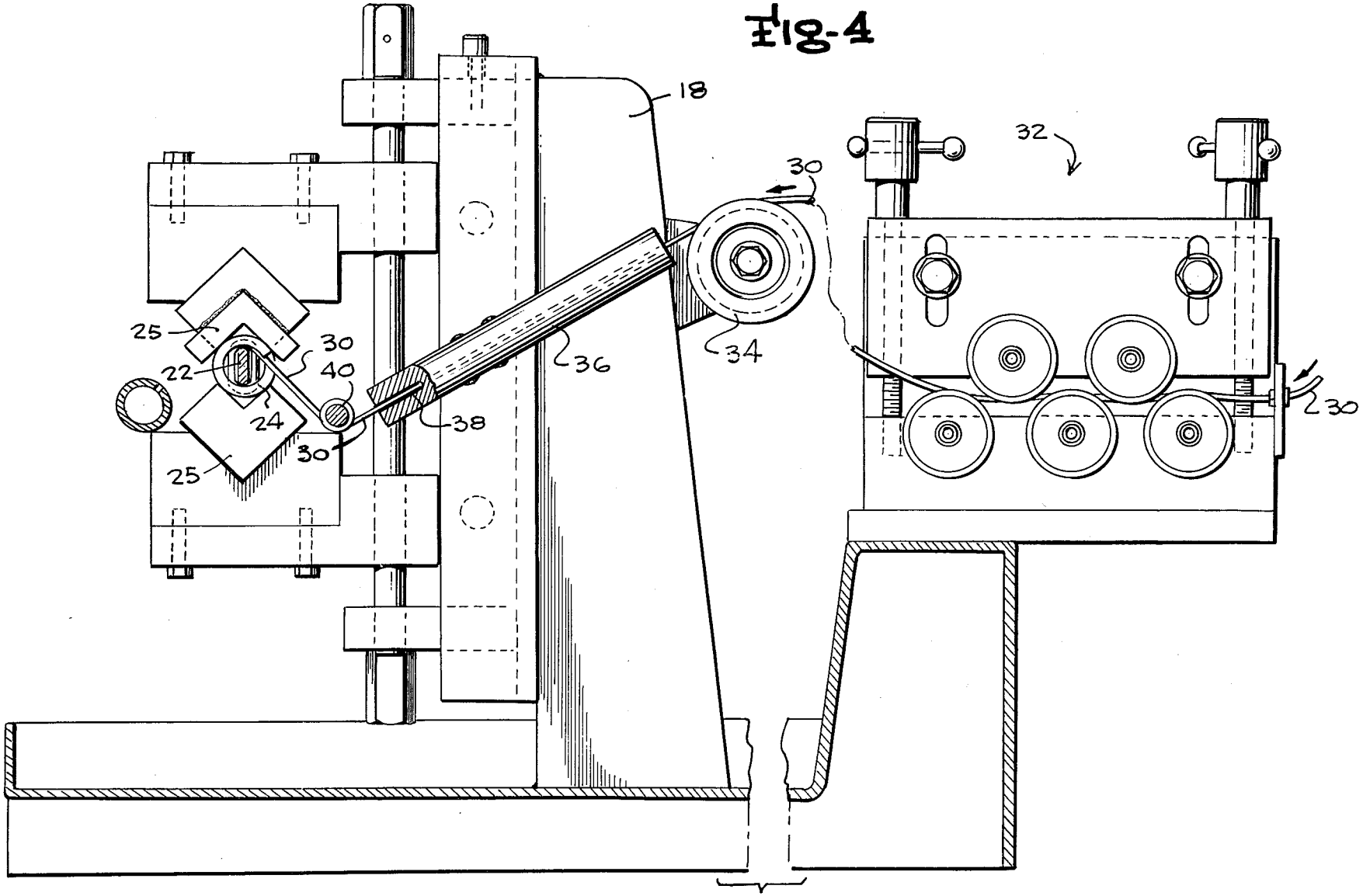
FIG. 4 is a side elevation partially in section of the apparatus of FIG. 3.

A supply of unannealed as-drawn high strength steel alloy wire 30 sold under the trademark "MAYARI R" by Bethlehem Steel Company of Bethlehem, Pa., having a maximum carbon content of 0.12%, a manganese range of 0.50% to 1.0%, a maximum phosphorous content of 0.12%, a maximum sulphur content of 0.05%, a silicon content in the range of 0.20 to 0.90%, a maximum copper content of 0.50%, a chromium content of 0.40 to 1.00%, a maximum nickel content of 1.00% and a maximum zirconium content of 0.10% is provided in a conventional manner. Wire 30 is fed inwardly through tensioning means 32 over an infeed guide pulley 34 to a linear guide means 36 having a bore 38 extending along its length and of a diameter slightly greater than the diameter of the wire. Linear guide means 36 stabilizes the feed of the wire and prevents vibrations of the type that would normally occur in long flights of unsupported wire sections with the wire leaving the linear guide means 36 and immediately passing under a back bend idler roller sheave means 40 positioned closely adjacent the linear guide means. Back bend roller sheave means 40 is of a relatively small diameter and the wire travels in a peripheral groove 42 in the roller sheave and is bent beyond its elastic limit so that a set bend is imparted to the wire which is then fed immediately into the spiral slot 26 of the spiral guide 24 and is wrapped around the rotating winding blade 22 to conform to the cross-sectional shape of the winding blade as shown in FIG. 4. The wrapping of the wire around the winding blade 22 results in a second bending of the wire in a direction exactly opposite the set bend imparted to the wire by the back bend roller 40. Continued rotation of the winding blade results in eventual movement of the elongated flat spiral wire member formed in the winding station outwardly of the winding and bending station as shown in FIG. 3.

The winding blade 22 serves to draw the wire through tensioning means 32, over infeed guide pulley 34, through the bore 38 of linear guide 36, over the roller 40 and into the spiral slot 26 of the spiral outfeed guides 24. It will be appreciated that the wire extending from the tensioning means 32 to the winding blade 22 is in substantial tension in accordance with the degree of adjustment of tensioning means 32. The flat spiral wire member 40 emerging from the leftmost spiral guide 24 is formed of a series of spaced parallel essentially linear top and bottom leg portions 42 connected by curved end portions 44. A woven conveyor belt is provided from the flat spiral wire members by provision of undulating connector rods 48 extending through the interleaved end portions 44 to provide a conveyor belt construction as shown in FIG. 2.

The inventive apparatus enables the formation of uniform flat spiral wire members of substantial dimensional uniformity which was previously achievable only with the use of soft annealed wire. Consequently, the elongated flat spiral members can be fabricated into woven conveyors with a minimum of difficulty.

Previous attempts to form conveyor belts of unannealed wire resulted in flat spiral wire members having internal stresses and strains which resulted in dimensional variations in pitch of spirals and twist which prevented the wire members from being interleaved and woven together to form a conveyor of the type illustrated in FIG. 2. Consequently, it will be appreciated that the subject invention represents a distinct advance in the art fully deserving of patent protection.

Conveyor belts formed of unannealed steel by the inventive apparatus and method are of particularly great utility when used as conveyors in the glass industry for conveying wire through lehrs and the like in which the temperatures do not exceed the annealling temperature of the wire. Consequently, the wire can be of smaller diameter than is required with annealed wire with the ability to use unannealed as-drawn wire resulting in substantial savings in material costs. Stretch comparison tests in which a woven conveyor belt formed of annealed MARARI R alloy as discussed on page 7 versus a woven conveyor belt formed of non-annealed as-drawn wire of the same composition reveals that the latter belt had one third less elongation under the same load than the annealed belt.

It should also be appreciated that the inventive method and apparatus is not limited to the use of the "MARARI R" alloy which is given as an example of a usable alloy. In fact, the invention will permit the formation of elongated spiral wire members of a wide variety of other spring-like metals such as medium and high carbon steels of a tensile strength higher than heretofore possible to use. The invention can also be used for forming elongated spiral wire members of other hard alloys having a chromium content of up to 3%, for example.

Actual tests have shown that by use of the aforedescribed devices, wire belts have been made of sufficiently high tensile strength to enable weight reduction of 30% to 50%. When used as conveyors in lehrs, these weight reductions provide heat savings in the range of 6,000,000 to 12,000,000 BTU's per day per lehr. There are perhaps 5,000 lehrs in operation in the U.S. today.

While modifications of the illustrated preferred embodiment will undoubtedly occur to those of skill in the art, it should be understood that the spirit and scope of the invention is to be limited solely by the appended claims.

I claim:

1. A method of forming an elongated flattened wire spiral of spring-like wire in a forming station having a continuously rotating elongated winding blade extending axially through a rigid flat spiral outfeed guide, said method comprising the steps of continuously feeding spring-like wire toward said forming station, bending said spring-like wire beyond its elastic limit in a first direction to impart a set bend in said wire at a location immediately upstream of said forming station, feeding said wire having said set bend into wrapped engagement with said winding blade between adjacent spirals of said flat spiral outfeed guide in a direction so that said wire is bent on said winding blade beyond its elastic limit in an opposite direction to said set bend as it is wrapped around said winding blade.

2. The method of claim 1 additionally including the step of guiding said wire along a fixed linear path immediately prior to imparting said set bend to said wire.

3. The method of claim 1 wherein said wire is maintained under controlled tension as said set bend is imparted to said wire and as said wire is wrapped around said winding blade and including the step of guiding and holding stable said wire along a fixed linear path immediately prior to imparting said set bend to said wire.

4. The method of claim 3 wherein said set bend is imparted to said wire by feeding said wire across a relatively small-diameter bending roller having a fixed axis spaced from the axis of rotation of said winding blade.

5. The method of claim 1 wherein said wire used in said method comprises as-drawn unannealed steel wire.

6. The method of claim 5 additionally including the step of guiding said wire along a fixed linear path immediately prior to imparting said set bend to said wire.

7. The method of claim 5 wherein said wire is maintained under controlled tension as said set bend is imparted to said wire and as said wire is wrapped around said winding blade and including the step of guiding and holding stable said wire along a fixed linear path immediately prior to imparting said set bend to said wire.

8. The method of claim 7 wherein said set bend is imparted to said wire by feeding said wire across a relatively small diameter bending roller mounted for rotation about an axis spaced from and parallel to the axis of rotation of said winding blade.

9. The method of claim 8 wherein said wire engages only a portion of the periphery of said bending roller and does not encircle said bending roller.

10. Means for forming an elongated flattened wire spiral of spring-like wire having a tensile strength in excess of 100,000 pounds per square inch comprising a forming station including an elongated continuously rotating driven winding blade, a rigid flat spiral outfeed guide member axially coextensive with and surrounding said elongated continuously rotating winding blade, wire infeed means for feeding wire to said forming station to be wrappingly bent around said winding blade, said wire infeed means including bending means immediately upstream of and closely spaced from said forming station for imparting a set bend to said wire immediately upstream of said forming station, said set bend being in an opposite direction to the bends imparted to said wire by the wrapped engagement of said wire with said winding blade so that an elongated flat spiral of said spring-like wire is formed by the wrapping of said wire onto said winding blade.

11. The invention of claim 10 additionally including linear guide means for guiding said wire along a fixed linear path immediately prior to engagement of said wire with said bending means and means for maintaining said wire under controlled tension.

12. The invention of claim 11 wherein said wire bending means comprises a relatively small-diameter roller means having an axis offset from the axis of said winding blade.

13. The invention of claim 12 wherein said linear guide means comprises an elongated member having a hollow linear bore of slightly greater diameter than the diameter of said wire and through which said wire is fed.

14. Feeding means for forming an elongated flattened wire spiral of spring-like wire comprising a forming station including an elongated motor driven rotating winding blade, a rigid flat spiral outfeed guide member axially coextensive with and surrounding said elongated continuously rotating winding blade, wire supply means, wire infeed means for feeding wire from said wire supply means to said forming station to be wrapped around said winding blade, said wire infeed means including wire tensioning means downstream of said wire supply means, bending means immediately upstream of and closely spaced from said forming station for imparting a set bend to said wire immediately upstream of said forming station in an opposite direction to the bend imparted to said wire by the wrapped engagement of said wire with said bending station so that an elongated flat spiral of said spring-like wire is formed by the wrapping of said wire onto said winding blade.

15. The invention of claim 14 additionally including linear guide means for guiding said wire along a fixed linear path to a location immediately adjacent the point at which said wire engages said bending means.

16. The invention of claim 14 wherein said wire bending means comprises a relatively small-diameter roller having a fixed axis of rotation offset from the axis of said winding blade and having a radius only slightly greater than the radius of curvature imparted to the wire by said winding blade.

17. The invention of claim 15 wherein said linear guide means comprises an elongated member having a hollow linear bore of slightly greater diameter than the diameter of said wire and through which bore said wire is fed.

18. The invention of claim 17 wherein said wire bending means includes a relatively small diameter roller means mounted for rotation about a fixedly positioned axis offset from and parallel to the axis of said winding blade.

* * * * *